US005380079A

United States Patent [19]

Hamilton

[11] Patent Number: 5,380,079

[45] Date of Patent: Jan. 10, 1995

[54] STORING DEVICE HAVING UPPER AND LOWER ROD SEPARATORS

[76] Inventor: C. E. Hamilton, 2 Old Market Place, Altrincham, Cheshire WA14 4NP, United Kingdom

[21] Appl. No.: 44,283

[22] Filed: Apr. 7, 1993

[51] Int. Cl.[6] ..... A47B 81/06; A47B 63/02; A47B 63/04

[52] U.S. Cl. ..... 312/9.55; 312/193; 312/281; 211/40; 211/184

[58] Field of Search ..... 312/193, 9.48, 9.52, 312/9.55, 9.53, 281, 140.4; 211/40, 184; 108/29, 31

[56] References Cited

U.S. PATENT DOCUMENTS

| | | | |
|---|---|---|---|
| D. 127,973 | 7/1941 | Replogle | 211/40 |
| D. 256,534 | 8/1980 | Bugos | 211/40 |
| 1,060,020 | 4/1913 | Pennewill | 211/184 |
| 1,229,330 | 6/1917 | Sharples | 312/9.53 |
| 2,760,839 | 8/1956 | Martin | 312/9.55 |
| 2,825,465 | 3/1958 | Burgo | 211/40 |
| 3,385,451 | 5/1968 | Anderson | 211/184 |

FOREIGN PATENT DOCUMENTS

| | | | |
|---|---|---|---|
| 1181017 | 6/1959 | France | 211/40 |
| 206330 | 11/1923 | United Kingdom | 312/9.53 |

*Primary Examiner*—Richard A. Bertsch
*Assistant Examiner*—Roland G. McAndrews, Jr.
*Attorney, Agent, or Firm*—Locke Reynolds

[57] ABSTRACT

A storing device (5) for flat articles such as cardboard, card, paper or the like or articles made therefrom includes a cabinet (10) housing a lower (22) and an upper (24) separator. Each separator (22, 24) comprises a plurality of rods (26) which extend from the base and top of the cabinet, respectively, to the back of the cabinet. The cardboard and like articles are stored between the rods (26) of the separators (22, 24).

13 Claims, 4 Drawing Sheets

STORING DEVICE HAVING UPPER AND LOWER ROD SEPARATORS

BACKGROUND OF THE INVENTION

This invention relates to storing devices and particularly, but not exclusively, to storing devices for storing flat articles such as card, cardboard, paper and the like.

One application of the card is for providing a border around pictures in a picture frame. A professional picture framer will need to store a large number and variety of such pieces of card. If the cards are stacked horizontally on the floor, it is very difficult to remove the cards at the base of the stack. It is difficult to stack the cards vertically without causing bowing. It is therefore preferable to use a storage device.

Known storage devices of this kind comprise a cabinet with timber board separators. These boards take up much space and consequently much storage space is wasted. It is also known to separate cards with vertical rods provided near the front of the cabinet. these rods do not provide a satisfactory separation from front to back and therefore adjoining varieties of the cards are readily mixed together.

The present invention has been made from a consideration of these problems.

SUMMARY OF THE INVENTION

According to the present invention, there is provided a storing device comprising at least two separators per division; said pairs of separators comprise a plurality of spaced apart members extending from substantially the front towards the rear of the storing device, wherein said members are operative to store substantially flat articles therebetween, one of said separators being located above the other in such a manner that the bottom portions of the articles may be retained between members of the lower separator and the upper portions of the sufficiently large articles may be retained between members of the upper separator.

In a preferred embodiment of the invention, the storage device comprises a cabinet. The separators are preferably located in the cabinet and made from rods. The upper members of the separators extend towards the base from the top of the cabinet and then through a 90° bend towards the rear of the cabinet. The lower members of the separators extend from the base of the cabinet towards the top and through a 90° bend and subsequently extend towards the rear of the cabinet.

The pairs of separators may be evenly spaced apart or unevenly spaced apart to provide the precise storage requirements needed by the user.

Lower and upper separators are preferably provided in the same vertical plane. The vertical spacing between the two separators is substantially the same as the height of the vertical part of the lower rods which in turn is substantially the same as the vertical distance the upper separator extends down from the top. This spacing is generally critical to achieve the non-bowing function of the storage device.

The separators may be either fixed as a complete set (e.g., all lower separators welded to two cross members and all upper separators welded to two other cross members for assembly into the cabinet) or installed in the cabinet individually and fixed by such means as bolts onto threaded ends or the use of rubber gripping collars.

The storing device is adapted to store flat articles of varying sizes. The storing device is particularly suitable for storing cardboard, card, paper and the like or articles made therefrom such as matboard for picture frames.

BRIEF DESCRIPTION OF THE DRAWINGS

In order that the invention may be more readily understood, a specific embodiment thereof will now be described by way of illustration only, with reference to the accompanying drawings in which.

DESCRIPTION OF THE PREFERRED EMBODIMENT

Figure 1:
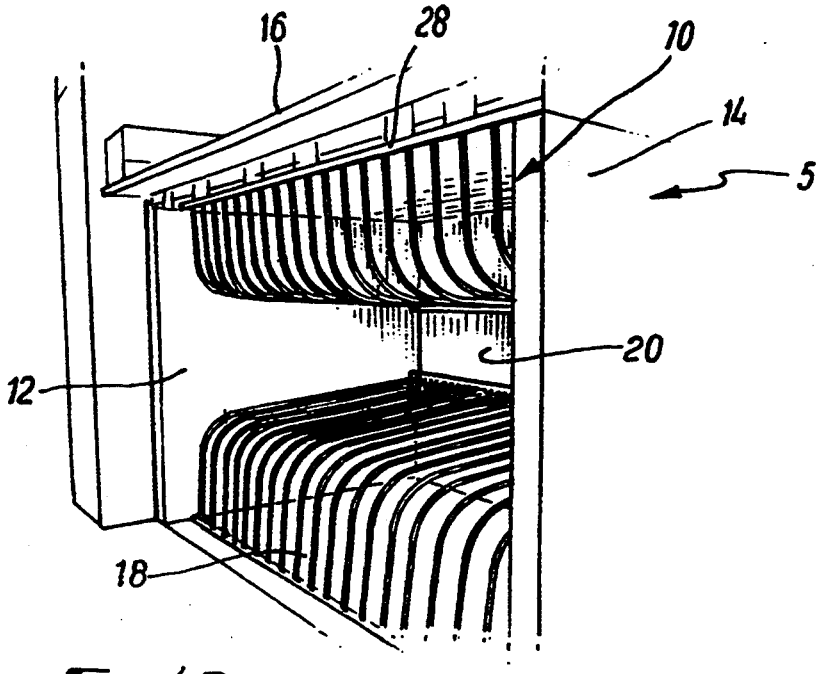
FIG. 1 is a perspective view of one storing device in accordance with the invention.
Figure 2:
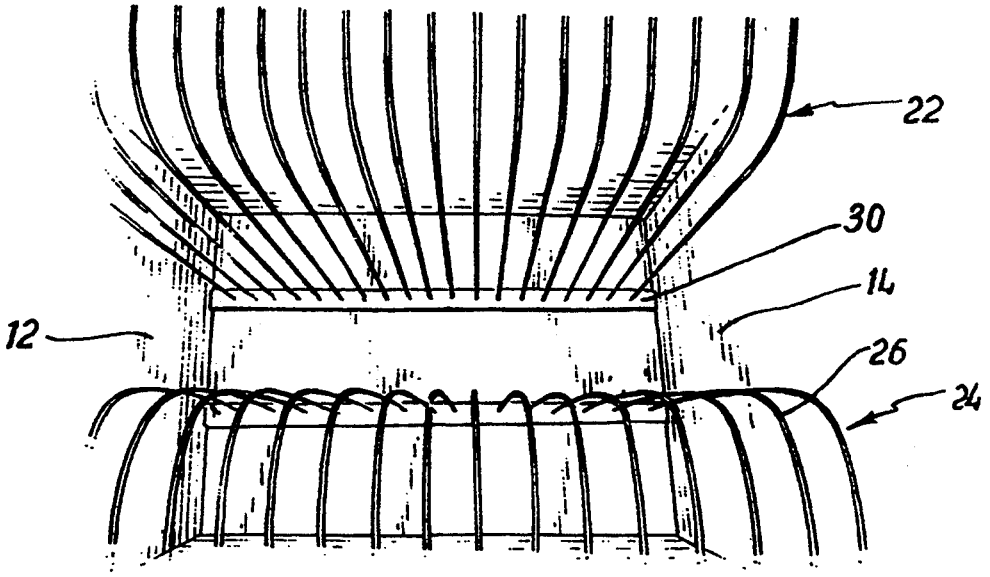
FIG. 2 is a front elevation of the storing device of FIG. 1.
Figure 3:
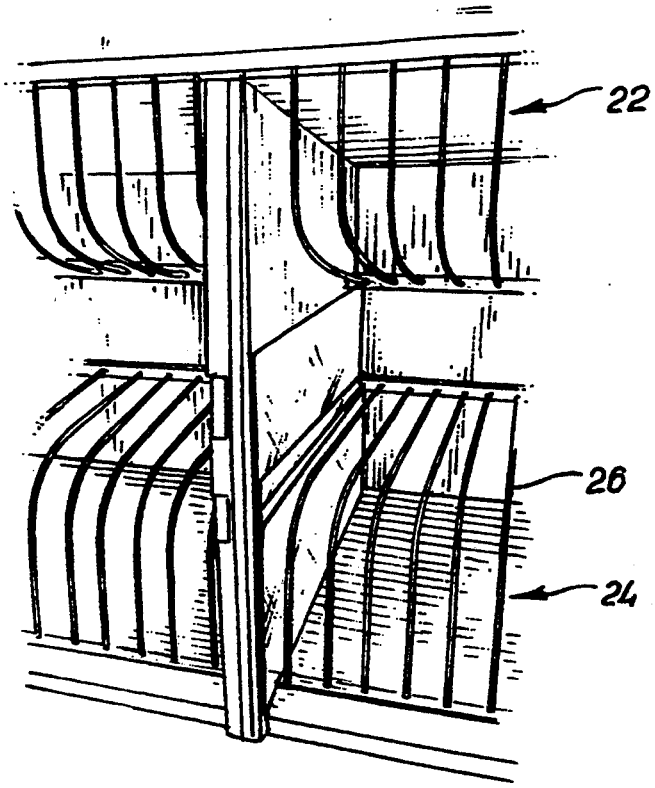
FIG. 3 is a front elevation of the storing device of FIGS. 1 and 2 in use.
Figure 4:
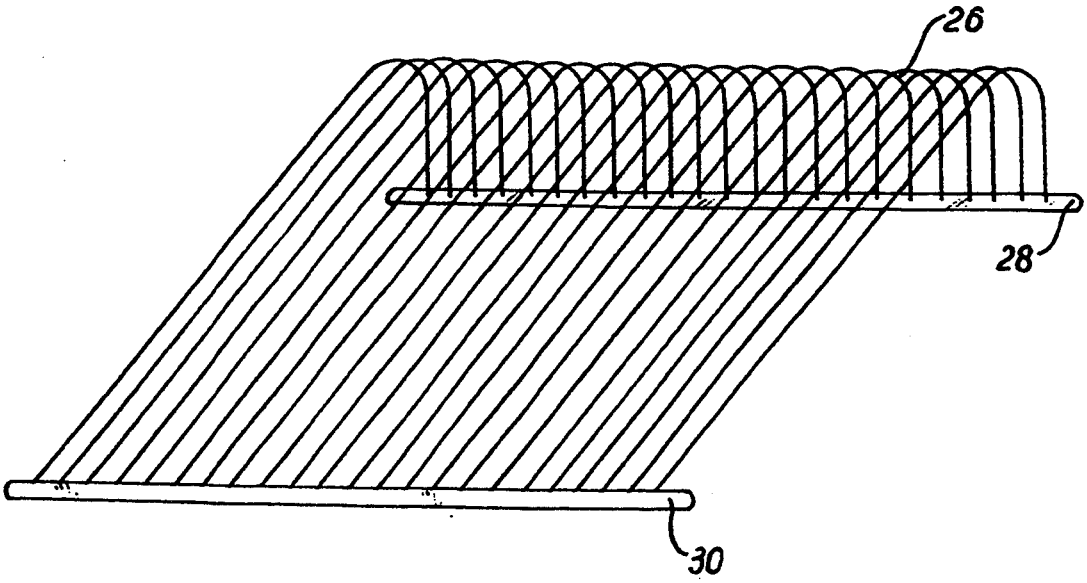
FIG. 4 is a perspective view of one type of separator configuration (i.e., welded together as a set) of the storage device of FIGS. 1 to 3.

Referring to the drawings, a storing device 5 comprises an open front cabinet 10 defined by side walls 12, 14, top 16, base 18 and rear wall 20. The height of the cabinet 10 is such that it can accommodate the largest flat articles such as pieces of card to be stored. The width of the cabinet is chosen such that it can accommodate a large number of pieces of card or items made therefrom with as many divisions as are likely to be required.

Two sets of separators 22, 24 are provided in the cabinet. One set of these separators, the upper separator 22, is located above the lower separator 24.

Each set of separators 22, 24 comprises a plurality of spaced apart (evenly or unevenly) rods 26. Each rod extends vertically, bends through 90° and subsequently extends horizontally towards the rear. The free ends of the vertical part of the rods of one separator 22, 24 are connected to a strip 28 in this configuration. The free ends of the horizontal part of the rods of one separator 22, 24 are connected to a second strip 30 in this same configuration. In this configuration, the connections are made by welding the rods to the strips 28, 30.

The strip 28 connected to the vertical part of the upper separator 22 is fixed to the front upper part of the cabinet 10. The strip 30 connected to the horizontal part of the upper separator 22 is fixed to the rear of the cabinet 10.

In another configuration of the separators, each of the rods 26 may be fixed individually to cabinet 10 in the same positions as above, but instead of welding to strips 28, 30 to either thread rods 26 and apply bolts or to use rubber gripping collars to hold each individual rod 26 in place.

The rods 26 of the two sets of separators are vertically aligned. The vertical part of the rods 26 are also inset from the front edge of the cabinet 10 to facilitate the inserting and withdrawing of the storage items.

The height of the vertical parts of the rods 26 of the upper and lower separators 22, 24 are substantially the same. This height is approximately the same as the spacing between the upper and lower separators to insure the stored items do not bend or bow regardless of the size of the item being stored.

Figure 5:
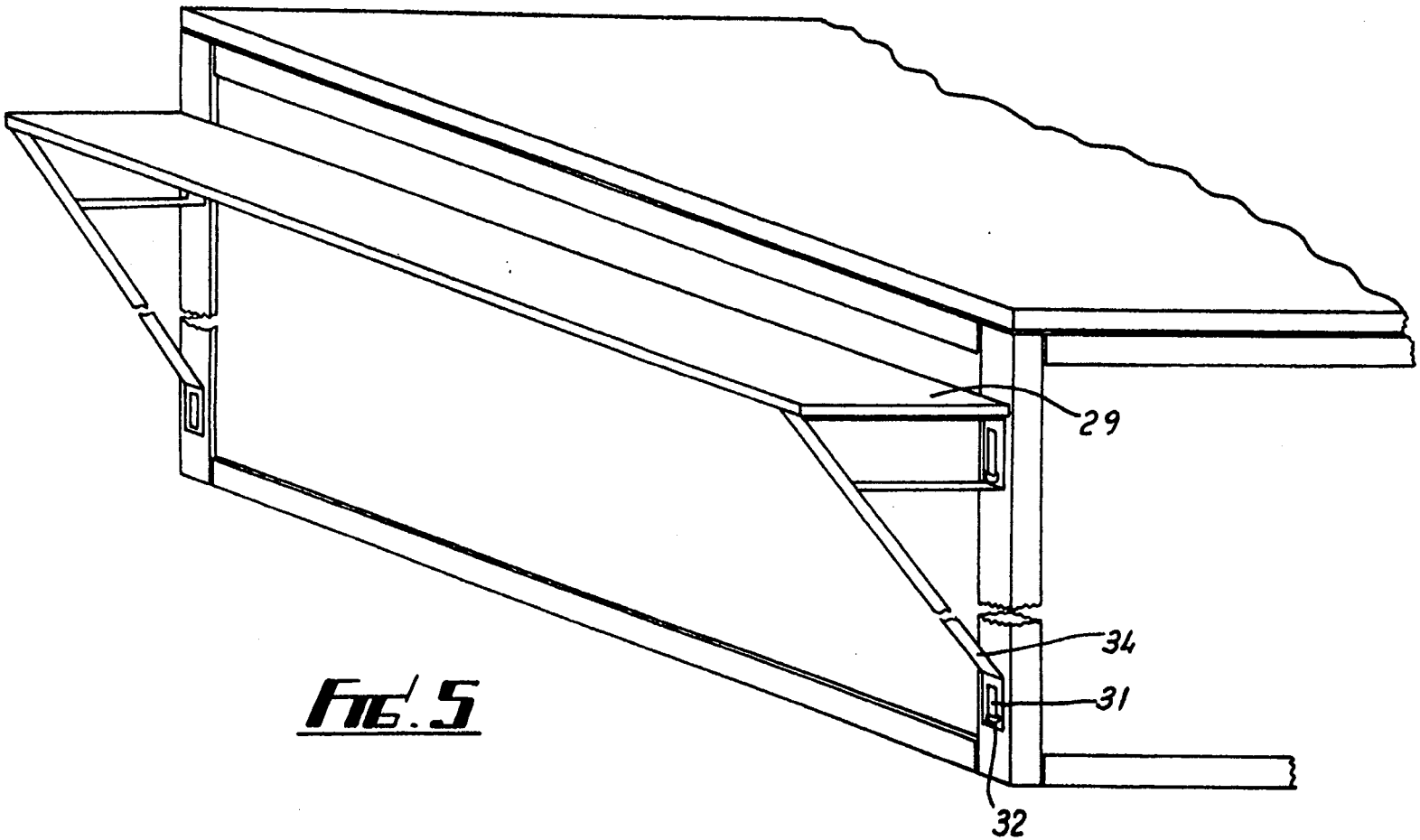
FIG. 5 is a perspective view of a preferred addition to the storage device of FIGS. 1 to 4.
Figure 6:
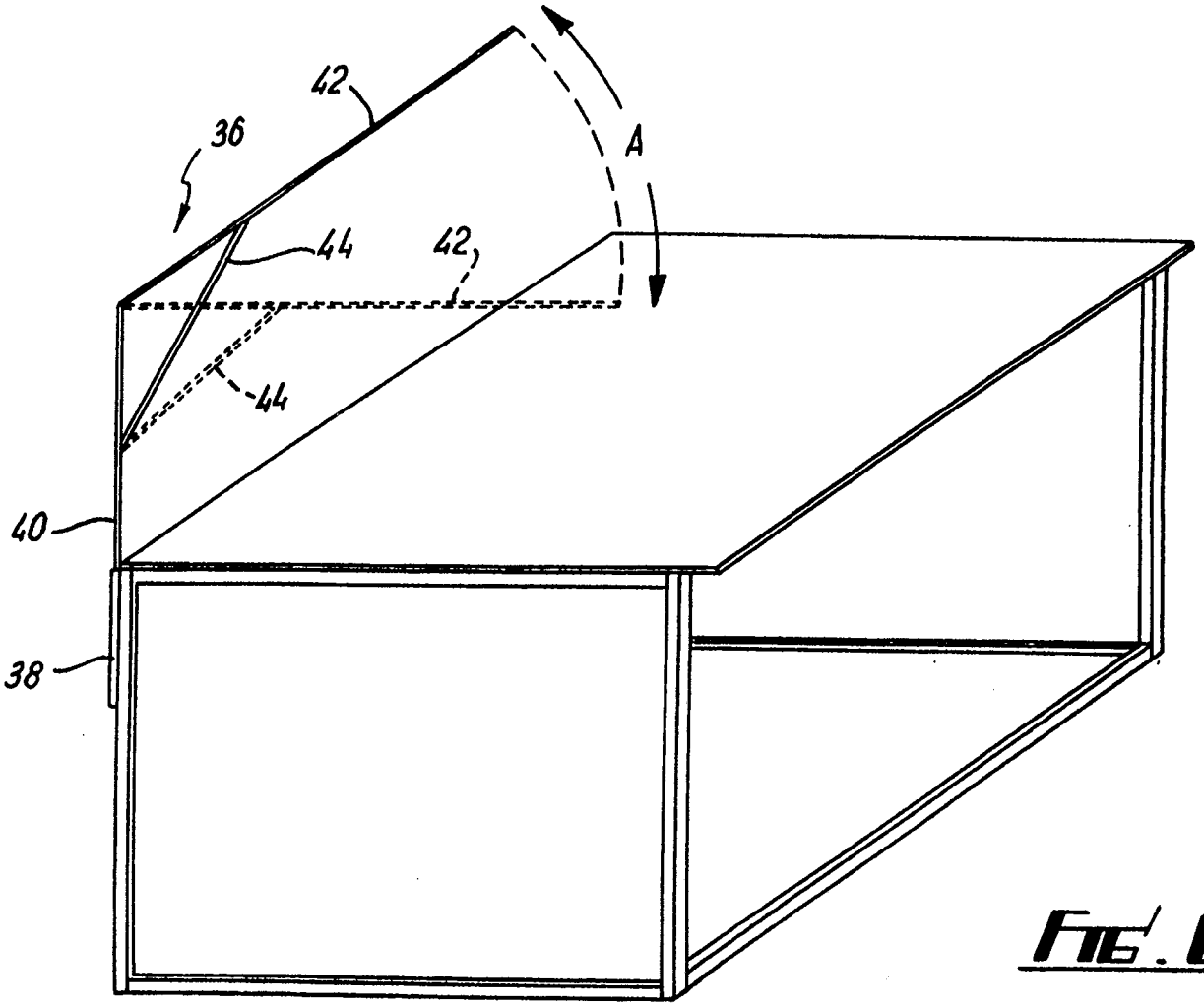
FIG. 6 is a perspective view of a further preferred addition to the storage device of FIGS. 1 to 5.

The attachments illustrated in FIGS. 5 and 6 may be secured to the cabinet 10.

FIG. 5 shows a shelf 29 which may be secured to one of the sides 12, 14 of the cabinet 10. The means of fixing the shelf 29 to the cabinet 10 allow the height of the shelf 29 to be adjusted preferably by at least 2 inches. The fixing means comprise four slots 31, in metal strips 34 descending from the underside of shelf 29. A securing screw 32 is passed through each slot 31. The head of the securing screw 32 when urged tightly against the part of the strip defining the slot 31 will hold the shelf 29 in position. In order to adjust the height of the shelf 29, the heads of the securing screws 32 are moved away from the slots 31, the shelf 29 is moved to the new position and the heads of the screws 32 are once again moved to engage the part of the strip defining the slots 30.

The shelf is designed to receive a special mat cutting machine for the card used by professional picture framers. The adjustment of the shelf described above is to accommodate different size and makes of such machines.

Referring to FIG. 6, a swing arm 36 is mounted for rotation in a vertical channel member 38 provided at the rear of the cabinet 10. The swing arm 36 comprises a vertical arm 40, one end of which is rotatably received in the channel member 38, a horizontal arm 42 extending from the other end of the vertical arm 40 and a support arm extending between the two are about 45°.

The swing arm is adapted to receive a special caddy for tools, screws, nails, tapes, wires, and other supplies used by professional picture framers. The caddy mounted in this way can be swung over or away from the upper surface of the cabinet 10 as the arm moves through arc "A". This allows the top of cabinet 10 to be kept clear of working instruments and materials and therefore usable as a working area for picture framing and at the same time make these items readily available for use.

In the embodiment described above, the cabinet and sides are made from heavy duty square steel tubing and electro-statically coated for good looks. The separator rods are made from steel wire which are plated or electro-statically coated for rust resistance. The cabinet top, and bottom may be made of wood as well as the infill sections of the two end frames.

The storing device of the present invention stores different colors and types of matboards separately. These matboards (used by all professional picture framers) may be easily retrieved from the storing device without any bowing or damage. The device also facilitates greater use of off cuts of matboards because it is capable of storing in the same separation the full sheets as well as varying sizes of off cuts of the matboard and thereby reducing scrap costs.

It is to be understood that the above-described embodiments have been described by way of illustration only. Many modifications and variations are possible.

What is claimed is:

1. A storing device for storing a plurality of substantially flat articles in a generally vertical orientation, the storing device comprising: a cabinet having a bottom, a top, a rear portion and an open front, an upper separator situated adjacent to the top and extending downwardly within the cabinet, a lower separator situated adjacent to the bottom and extending upwardly within the cabinet but vertically spaced from the upper separator, each separator comprising a plurality of horizontally spaced rods extending from substantially the open front of the cabinet to the rear of the cabinet, each rod having a forward and a rearward end separated by a 90° bend, the rearward end of each rod being spaced from both the top and the bottom of the cabinet, a vertically middle portion of the cabinet between the upper and lower separator being unobstructed so that any of the articles may be easily removed from the storing device.

2. A storing device as claimed in claim 1 wherein each separator further comprises a front cross member fixed to the rod forward ends and a rear cross-member fixed to the rod rearward ends.

3. A storing device as claimed in claim 1 wherein the vertical dimension of the upper and lower separator is substantially equal to the vertical spacing between the upper and lower separator.

4. A storing device as claimed in claim 1 wherein the horizontal spacing of the rods forming the upper and lower separator are equal to each other.

5. A storing device as claimed in claim 1 wherein the rods forming the upper and lower separator are vertically aligned with each other.

6. A storing device as claimed in claim 1 wherein each of the rods forming the upper and lower separator include a front portion, the front portions being aligned substantially in a common vertical plane.

7. A storing device as claimed in claim 1 wherein each of the rods forming the upper separator include a lowermost portion, the lowermost portions being aligned substantially in a common horizontal plane.

8. A storing device as claimed in claim 1 wherein each of the rods forming the lower separator include an uppermost portion, the uppermost portions being aligned substantially in a common horizontal plane.

9. A storing device for storing a plurality of substantially flat articles in a generally vertical orientation, the storing device comprising: a cabinet having a bottom, a top, a rear portion and an open front, an upper separator situated adjacent to the top and extending downwardly within the cabinet, a lower separator situated adjacent to the bottom and extending upwardly within the cabinet but vertically spaced from the upper separator, the vertical dimension of the upper and lower separator being substantially equal to the vertical spacing between the upper and lower separator, each separator comprising a plurality of horizontally spaced rods extending from substantially the open front of the cabinet to the rear of the cabinet, a vertically middle portion of the cabinet between the upper and lower separator being unobstructed so that any of the articles may be easily removed from the storing device, each of the members forming the upper and lower separators comprising a rod having a forward and a rearward end separated by a 90° bend, the horizontal spacing of the rods forming the upper and lower separator being equal to each other so that the rods forming the upper and lower separator are vertically aligned with each other, each of the rods forming the upper and lower separator including a front portion, the front portions being aligned substantially in a common vertical plane, each of the rods forming the upper separator including a lowermost portion, the lowermost portions being aligned substantially in a common horizontal plane, the rods forming the lower separator including an uppermost portion, the uppermost portions being aligned substantially in a common horizontal plane.

10. A storing device for storing a plurality of substantially flat articles in a generally vertical orientation, the storing device comprising: a cabinet having a bottom, a top, a rear portion and an open front, an upper separator situated adjacent to the top and extending downwardly within the cabinet, a lower separator situated adjacent to the bottom and extending upwardly within the cabinet but vertically spaced from the upper separator, each separator comprising a plurality of horizontally spaced members, each of the members forming the upper and lower separators comprising a rod having a forward and a rearward end separated by a 90° bend, each rod extending from substantially the open front of the cabinet to the rear of the cabinet, each separator further comprising a front cross member fixed to the rod forward ends and a rear cross-member fixed to the rod rearward ends, the front cross members of the upper and lower separator being respectively fixed to the top and bottom of the cabinet, each of the members forming the upper separator include a lowermost portion, the lowermost portions being aligned substantially in a first common horizontal plane, each of the members forming the lower separator include an uppermost portion, the uppermost portions being aligned substantially in a second common horizontal plane, the first and second planes being vertically separated to form a vertically middle portion of the cabinet between the upper and lower separators which is unobstructed so that any of the articles may be easily removed from the storing device.

11.. A storing device as claimed in claim 10 wherein the vertical dimension of the upper and lower separator of substantially equal to the vertical spacing between the upper and lower separator.

12. A storing device as claimed in claim 11 wherein the horizontal spacing of the members forming the upper and lower separator are equal to each other.

13. A storing device as claimed in claim 12 wherein the members forming the upper and lower separator are vertically aligned with each other.

* * * * *